US010731365B2

(12) United States Patent
Ciarlariello et al.

(10) Patent No.: US 10,731,365 B2
(45) Date of Patent: Aug. 4, 2020

(54) APPARATUS FOR SECURING A COPING FORM

(71) Applicants: Nicola Ciarlariello, La Salle (CA); Michael Anthony Rizza, Maidstone (CA)

(72) Inventors: Nicola Ciarlariello, La Salle (CA); Michael Anthony Rizza, Maidstone (CA)

( * ) Notice: Subject to any disclaimer, the term of this patent is extended or adjusted under 35 U.S.C. 154(b) by 158 days.

(21) Appl. No.: 15/803,551

(22) Filed: Nov. 3, 2017

(65) Prior Publication Data

US 2019/0136560 A1 May 9, 2019

(51) Int. Cl.
*E04G 13/00* (2006.01)
*E04H 4/00* (2006.01)
*E04H 4/14* (2006.01)

(52) U.S. Cl.
CPC ..... *E04H 4/0075* (2013.01); *E04G 13/00* (2013.01); *E04H 4/141* (2013.01)

(58) Field of Classification Search
CPC ..... E04H 4/0075; E04H 4/0081
USPC ..... 249/214, 218
See application file for complete search history.

(56) References Cited

U.S. PATENT DOCUMENTS 1,898,332 A * 2/1933 Anderson ..... E04G 17/0758 249/218
3,186,677 A * 6/1965 Dudley ..... E04G 17/0754 249/41
3,348,801 A * 10/1967 Deason ..... E04G 11/365 249/19
3,605,357 A * 9/1971 Stegmeier ..... E04B 1/6803 52/98
3,625,470 A * 12/1971 Shoemaker ..... E04G 17/0721 249/214
3,708,930 A * 1/1973 Stegmeier ..... E04B 1/6803 52/98
3,745,727 A * 7/1973 Chichester, Sr. ..... E04H 4/0043 52/169.7
3,776,501 A * 12/1973 Loftin ..... E04H 4/141 249/2
3,872,195 A * 3/1975 Stegmeier ..... E04B 1/6803 264/35
3,920,214 A * 11/1975 Lovisa ..... E04G 17/0652 249/40
3,967,422 A * 7/1976 Stegmeier ..... E04H 4/141 52/169.7
4,048,270 A * 9/1977 Stegmeier ..... E04H 4/141 264/34
4,136,850 A * 1/1979 Grosch ..... E04H 4/0075 249/19
4,245,810 A * 1/1981 Green ..... E04H 4/0075 249/19

(Continued)

*Primary Examiner* — Michael Safavi
(74) *Attorney, Agent, or Firm* — Burris Law, PLLC

(57) ABSTRACT

A forming apparatus for securing a foam coping core is herein disclosed. The apparatus includes a bracket having a bracket body having an outer face and an opposing inner face, the inner face configured to press against the outer surface of the foam coping core, and one or more slots extending through the bracket body from the outer face to the inner face. A cantilever member is configured for insertion through the bracket body via the one or more slots. The cantilever member secures the bracket to a foam coping core during forming operations.

17 Claims, 10 Drawing Sheets

(56) References Cited

U.S. PATENT DOCUMENTS 4,318,254 A * 3/1982 Stegmeier ..... E04H 4/141 52/169.7
4,340,200 A * 7/1982 Stegmeier ..... E04G 13/00 249/168
4,387,877 A * 6/1983 Deason ..... E04G 13/00 249/10
4,395,014 A * 7/1983 Deason ..... E04H 4/141 249/10
4,574,017 A * 3/1986 Stegmeier ..... E04H 4/141 156/247
4,601,073 A * 7/1986 Methot ..... E04H 4/142 4/506
4,625,343 A * 12/1986 Bumgarner, Sr. ..... E04H 4/141 249/DIG. 3
4,706,308 A * 11/1987 Palmere ..... E04H 4/142 4/496
4,735,395 A * 4/1988 Dahowski ..... E02D 29/16 249/10
5,065,461 A * 11/1991 Shehan ..... E04H 4/10 4/503
5,107,551 A * 4/1992 Weir ..... E04H 4/14 4/496
5,134,819 A * 8/1992 Boyack ..... E04H 4/142 4/506
5,170,517 A * 12/1992 Stegmeier ..... E04H 4/14 4/496
5,695,586 A * 12/1997 Stegmeier ..... B29C 33/14 156/245
6,260,313 B1 * 7/2001 Stegmeier ..... E04H 4/142 4/488
6,529,664 B1 * 3/2003 Deason ..... E04H 4/141 156/245
8,960,636 B1 * 2/2015 Stegmeier, Jr. ..... E04G 13/00 249/19
2005/0001139 A1 * 1/2005 Musser ..... E04G 11/365 249/23
2005/0011153 A1 * 1/2005 Stegmeier ..... E04H 4/141 52/396.05
2016/0115701 A1 * 4/2016 Baldoni ..... E04H 4/141 52/300
2016/0237703 A1 * 8/2016 Deason ..... E04G 13/06

* cited by examiner

APPARATUS FOR SECURING A COPING FORM

FIELD

The present disclosure relates to a forming apparatus for concrete coping applications.

BACKGROUND

The statements in this section merely provide background information related to the present disclosure and may not constitute prior art.

Forming apparatuses are known in the art. These apparatuses are used for various concrete coping applications, including swimming pool copings. These apparatuses typically involve a bracket mechanism used to secure a form in place, in order to maintain positioning of the form during the concrete pouring application. Often, a securing mechanism, such as a tie-wire combined with a fastening screw may be used to further secure the form in place against a pool wall during swimming pool coping applications. Tie-wire type fasteners are often single use, and then are discarded after forming is complete.

Many forming apparatuses used in the art are specifically designed for a specification application, involving a form of predetermined size and spacing. Some adjustable forming apparatuses involve various components which must be assembled, making use cumbersome and challenging.

Accordingly, forming apparatuses are not that simple to use, have many components, and are not that adjustable, especially across a variety of applications. These limitations of forming apparatuses are addressed by the present disclosure.

SUMMARY

Disclosed herein is a forming apparatus for securing a foam coping core having core body with an opposing outer surface and inner surface to a wall during cement forming operations. The forming apparatus comprises a bracket having a bracket body having an outer face and an opposing inner face, the inner face configured to press against the outer surface of the foam coping core, and one or more slots extending through the bracket body from the outer face to the inner face and/or a cantilever member configured for insertion through the bracket body via the one or more slots. The cantilever member comprises a top surface and an opposing bottom surface, a fastening end an opposing insertion end configured for insertion through the core body and the one or more slots thereby extending at least a portion of the fastening end outward from the inner face of the bracket of and least a portion of the insertion end received within the one or more slots. In some forms, the cantilever member may comprise a plate.

In some forms, at least the portion of the insertion end may be received within the one or more slots and further extend outward from the outer face of the bracket.

In some forms, such a forming apparatus may further include a locking mechanism for securing the cantilever member within the one or more slots. In some forms, the locking mechanism may include one or more pinhole apertures extending through the cantilever member from the top surface to the bottom surface, and a pin configured for being releasably secured within the one or more pinhole apertures. In some forms, the one or more pin hole apertures may comprise a plurality of pinhole apertures spread substantially across the cantilever member.

In some forms, the one or more slots of the bracket may include a first slot and a second slot. Furthermore, the first and second slot may have substantially different orientations relative to one another along the bracket body. In some forms, the first and second slot are substantially perpendicular relative to one another along the bracket body.

In some forms, such a forming apparatus may further include one or more tie-wire apertures extending through the bracket body from the outer face to the inner face, the one or more tie-wire apertures configured to receive a tie-wire.

In some forms, such a forming apparatus may further comprise one or more fastening apertures disposed upon the fastening end of the cantilever member, the one or more fastening apertures extending through the cantilever member from the top surface to the bottom surface.

In some forms, the fastening end of the cantilever member may further comprise a breaking segment defining a breakable portion. In some forms, the breaking segment may include a narrowed portion formed upon the fastening end of the cantilever member.

In some forms, the bracket may further comprise one or more spools. The bracket may comprise a top end and a bottom end, and the one or more spools may include a top spool disposed upon the top end of the bracket and a bottom spool disposed upon the bottom end. In some forms, such a forming apparatus may further include one or more securing line holding members. The one or more securing line holding members may include a tapered slot. In some forms, the one or more securing line holding members are disposed upon the one or more spools. Furthermore, in some forms, the one or more securing line holding members may include a top tapered slot disposed upon the top spool and bottom tapered slot disposed upon the bottom spool.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
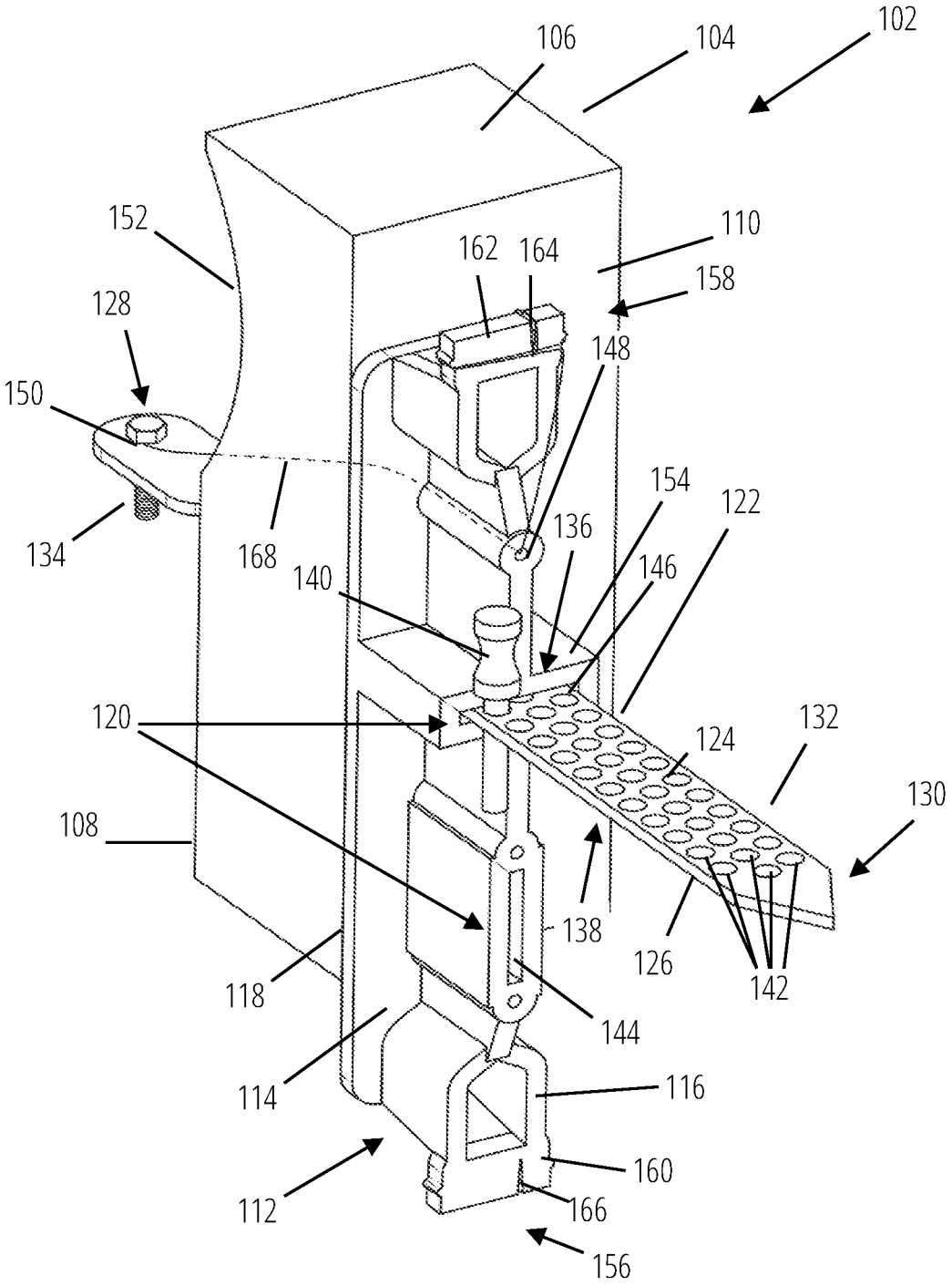
FIG. 1 is a perspective view of a forming apparatus constructed according to the teachings of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Figure 2:
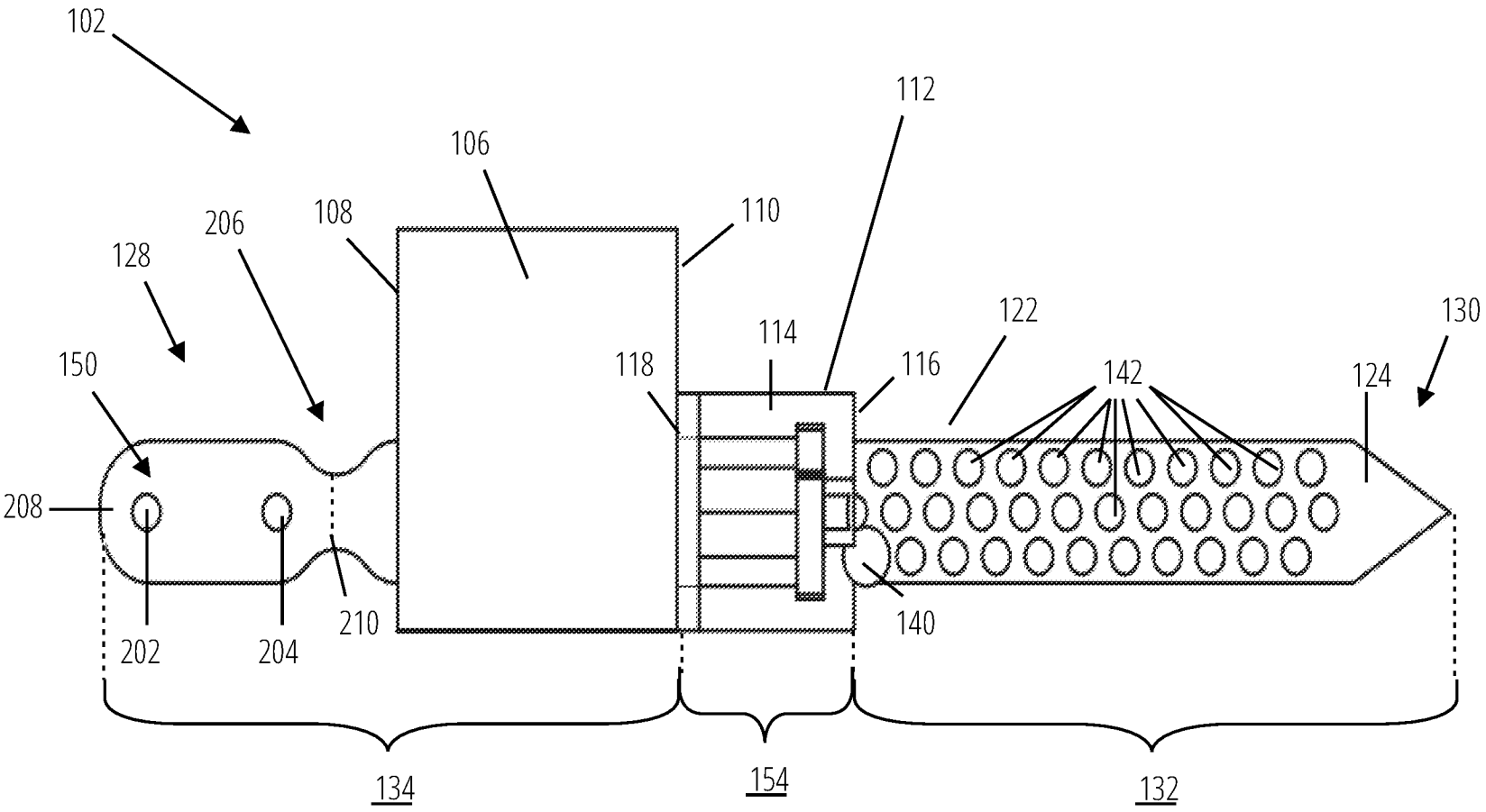
FIG. 2 is a top view of the forming apparatus of FIG. 1.
Figure 3:
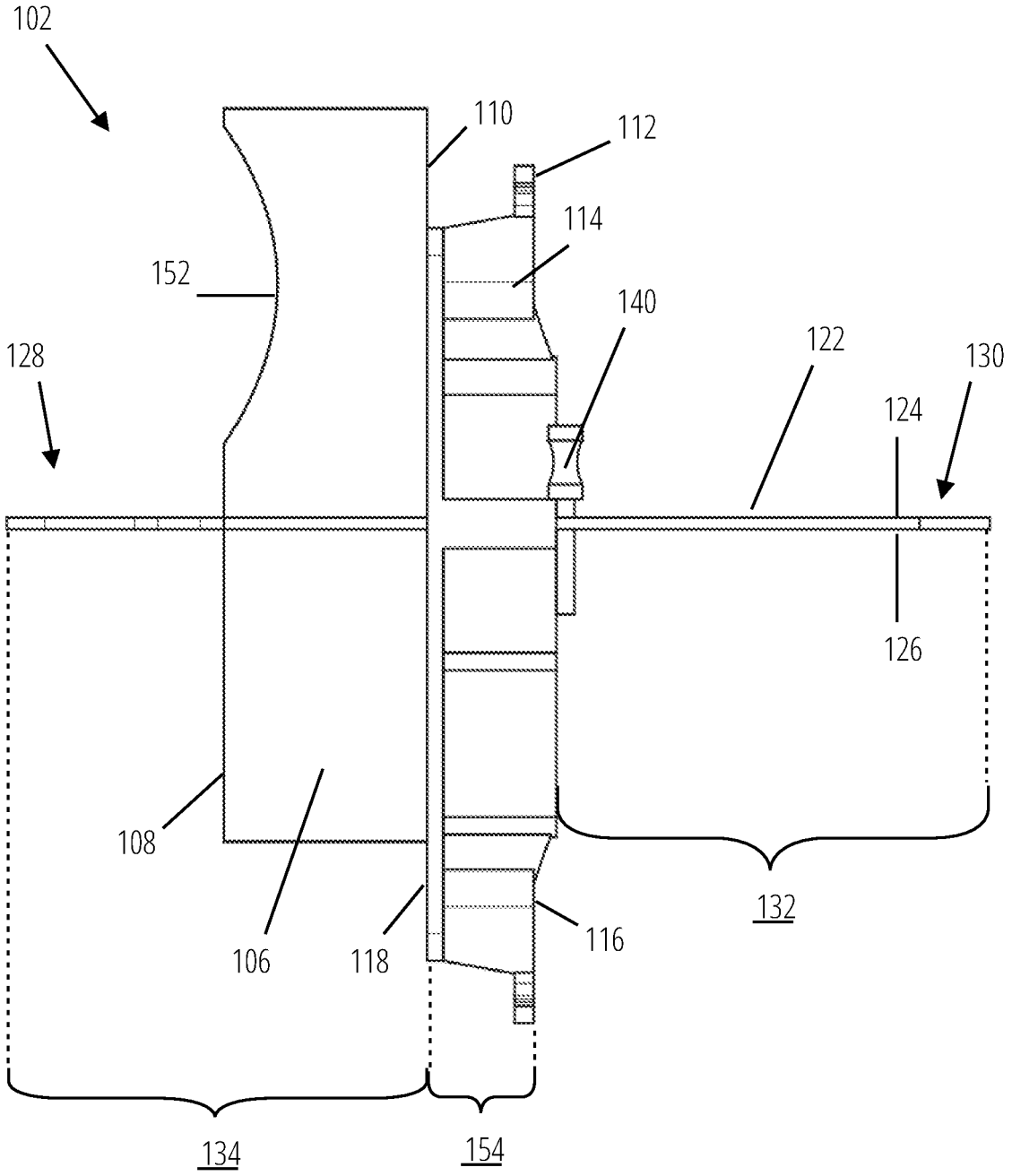
FIG. 3 is a side view of the forming apparatus of FIG. 1.

Referring to FIGS. 1-3, disclosed is one form of a forming apparatus 102 according to the teachings of the present disclosure. The forming apparatus 102 is used for securing a foam coping core 104 having a core body 106 with an opposing outer surface 110 and inner surface 108 to a wall during cement forming operations. As discussed below, the form disclosed herein may be used for cement forming operations involving the forming of a swimming pool coping 702. However, the claimed subject matter is not limited to such specific forming applications and may be implemented in a number of different forming application in accordance with the subject matter disclosed and claims herein.

In one form, the forming apparatus 102 comprises a bracket 112 having a bracket body 114. The bracket body 114 has an outer face 116 and an opposing inner face 118, the inner face 118 configured to press against the outer surface 110 of the foam coping core 104. The bracket 112 further comprises one or more slots 120 extending through the bracket body 114 from the outer face 116 to the inner face 118.

The forming apparatus 102 further comprises a cantilever member 122 configured for insertion through the bracket body 114 via the one or more slots 120. The cantilever member 122 has a top surface 124 and an opposing bottom surface 126, a fastening end 128 and an opposing insertion end 130 configured for insertion through the core body 106 and the one or more slots 120 thereby extending at least a portion of the fastening end 134 outward from the inner face 118 of the bracket 112 and at least a portion of the insertion end received within the one or more slots 154. As illustrated in the disclosed form, the cantilever member 122 comprises a plate of substantially planar configuration. However, the scope of the cantilever member 122 should not be limited to this particular form and one skilled in the art would appreciate based on the teachings disclosed herein that the cantilever member 122 may comprise any number of members of different configurations which serve the function disclosed herein, including but not limited to a pin configuration.

The forming apparatus 102 may include the at least a portion of the insertion end 132 further extending outward from the outer face 116 of the bracket 112. The forming apparatus 102 may further comprise a locking mechanism 136 for securing the cantilever member 122 within the one or more slots 120. The locking mechanism 136 of this particular form comprises one or more pin hole apertures 138 extending through the cantilever member 122 from the top surface 124 to the bottom surface 126, and a pin 140 configured for being releasably secured within the one or more pin hole apertures 138. The one or more pin hole apertures 138 comprises a plurality of pinhole apertures 142 spread substantially across the cantilever member 122. However, the locking mechanism 136 of should not be limited to this particular form, and one skilled in the art would appreciate that any number of suitable locking mechanisms not disclosed here could function according to the disclosed teachings. For example, a zip-tie type mechanism, with a biased locking pin and corresponding grooves could also work to secure the cantilever member 122 within the one or more slots 120. As such, the locking mechanism 136 could include a broad number of mechanisms that could serve the function of securing the cantilever member 122 within the one or more slots 120.

The one or more slots 120 comprises a first slot 144 and a second slot 146. As discussed in detail below, the first slot 144 and second slot 146 may have substantially different orientations relative to one another along the bracket body 114, and in the particular form disclosed herein, first slot 144 and second slot 146 are substantially perpendicular relative to one another along the bracket body 114. These exemplary forms regarding number of slots and orientation are not limiting, and as will become apparent herein, any number of slots with various orientations may be employed without departing from the scope of the subject matter disclosed and claimed herein.

In use, a user may position the bracket 112 such that the inner face 118 presses against the outer surface 110 of the foam coping core 104. A user may insert the insertion end 130 of the cantilever member 122 through the inner surface 108 of the foam coping core 104, pressing it through the core body 106 and outward from the outer surface 110. The cantilever member 122 may then be received within the one or more slots 120 such that a portion of the insertion end received within the one or more slots 154. The cantilever member 122 is received within the second slot 146. A portion of the fastening end 134 extends outward from the inner face 118 of the bracket 112 and outward from the inner surface 108 of the foam coping core 104. This portion of the fastening end 134, as discussed below, is used to secure the cantilever member 122 to the wall, and correspondingly the foam coping core 104 against the wall during cement forming operation.

The forming apparatus 102 may comprise one or more spools. In the particular disclosed form, the bracket 112 comprises a top end 158 and a bottom end 156, and the one or more spools comprises a top spool 162 disposed upon the top end 158 of the bracket 112 and a bottom spool 160 disposed upon the bottom end 156 of the bracket 112. As illustrated in FIG. 1 (and discussed in greater detail below), the securing line 168 may be utilized to secure the bracket 112 against the core body 106, to secure the core body 106 during cement pouring operations. A securing line 168 may comprise any number of securing lines of suitable strength used in the field, including but not limited to nylon, nylon thread, and light gage metal. The securing line 168 may be received through the bracket 112 and wrapped around the one or more spools to tighten the securing line 168 and thereby further securing the bracket 112 against the core body 106. The securing line 168 is wrapped tightly around the top spool 162. However, this is only one particular arrangement of the one or more spools and any number of configurations could be implemented without departing from the scope of the claimed subject matter.

Referring again to the form of FIG. 1, the forming apparatus 102 may further comprise one or more securing line holding members. One or more securing line holding members may be disposed upon the one or more spools. The one or more securing line holding members comprise a top tapered slot 164 disposed upon the top spool 162 and a bottom tapered slot 166 disposed upon the bottom spool 160.

The tapered slot of the top tapered slot 164 receives the securing line 168 after it has been tightly wrapped around the top spool 162, and holds it securely therein. This permits the securing line 168 to be tightly secured to the top spool 162 and the bracket 112, reducing the risk that it will come loose during forming operations.

The locking mechanism 136 comprises one or more pin hole apertures 138 and a pin 140 configured for being releasably secured within the one or more pin hole apertures 138. A user would insert the pin 140 into one of the one or more pin hole apertures 138. The pin 140 abuts against the outer face 116 of the bracket body 114, thereby preventing the insertion end 130 of the cantilever member 122 from being pulled outward from the inner face 118 of the one or more slots 120, and specific to the particular form the second slot 146. The one or more slots 120 comprises a plurality of pinhole apertures 142 spread substantially across the cantilever member 122. As seen particularly in FIGS. 2-3, the incorporation of a plurality of pinhole apertures 142 permits a user to vary the portion of the fastening end 134 extending outward from the inner face 118 and a portion of the insertion end 132 extending outward from outer face 116. This allows a user to use a cantilever member 122 of a single size (i.e. length, width, etc.) and accommodate for any number of different foam coping core 104 sizes (width, thickness, etc.). Furthermore, a user may adjust the portion of the fastening end 134 extending outward from the inner face 118 of the bracket 112 for different forming operations, if greater length of this portion of the fastening end 134 is needed for further coping support.

As illustrated in the particular form of FIG. 2, the fastening end 128 of the forming apparatus 102 may further comprise a breaking segment 206 defining a breakable portion 208. The breaking segment 206 comprises a narrowed portion 210 formed upon the fastening end 128 of the cantilever member 122. In use (and as discussed below), the breaking segment 206 can comprise any mechanism permitting a user to conveniently break the breakable portion 208 from the cantilever member 122 during use, including (without limitation) perforations or any structural weakening of the cantilever member 122. The narrowed portion 210 weakens this region of the cantilever member 122 allowing a user to conveniently separate the breakable portion 208 from the cantilever member 122.

Figure 4:
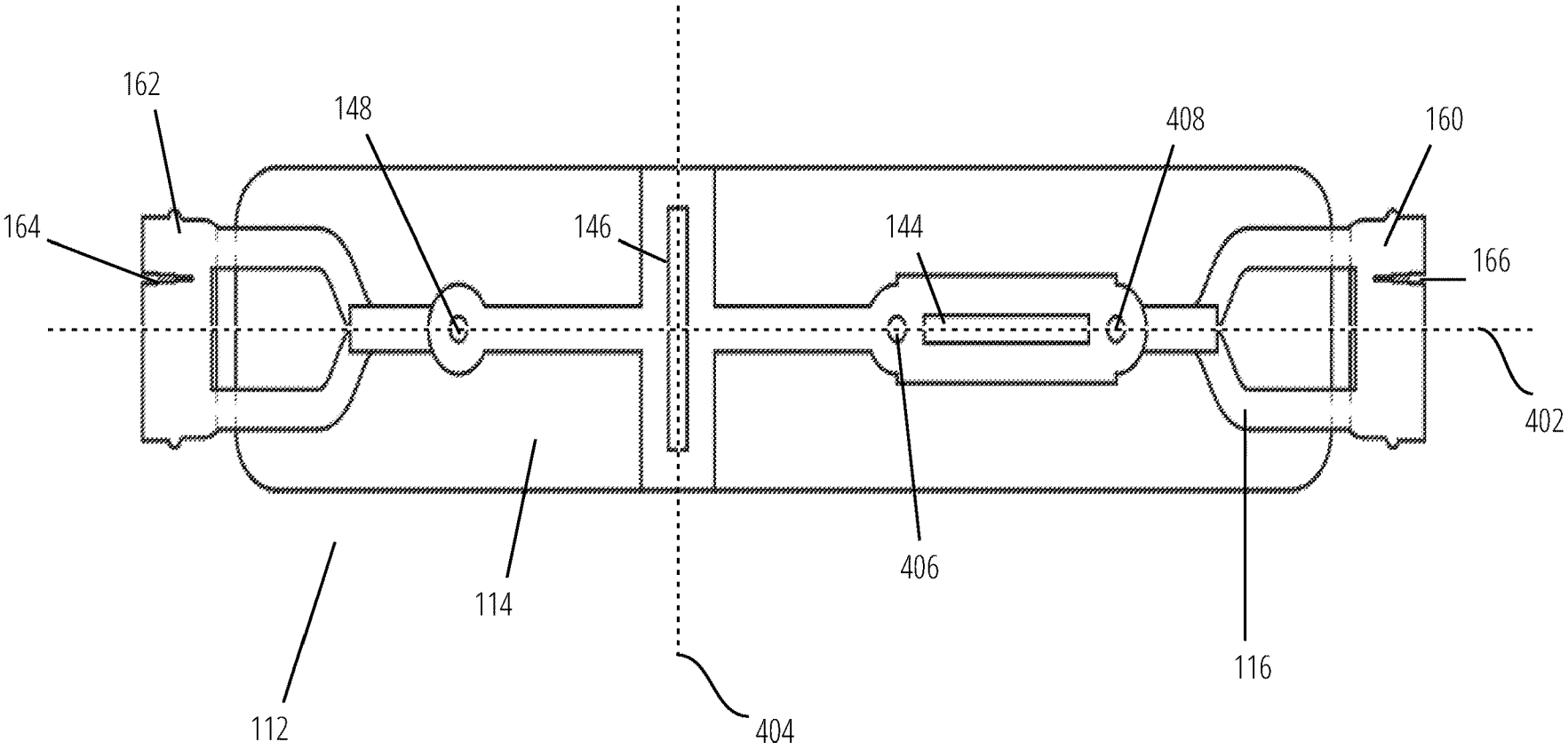
FIG. 4 is a top view of an outer face of a bracket of a forming apparatus constructed according to the teachings of the present disclosure.
Figure 5:
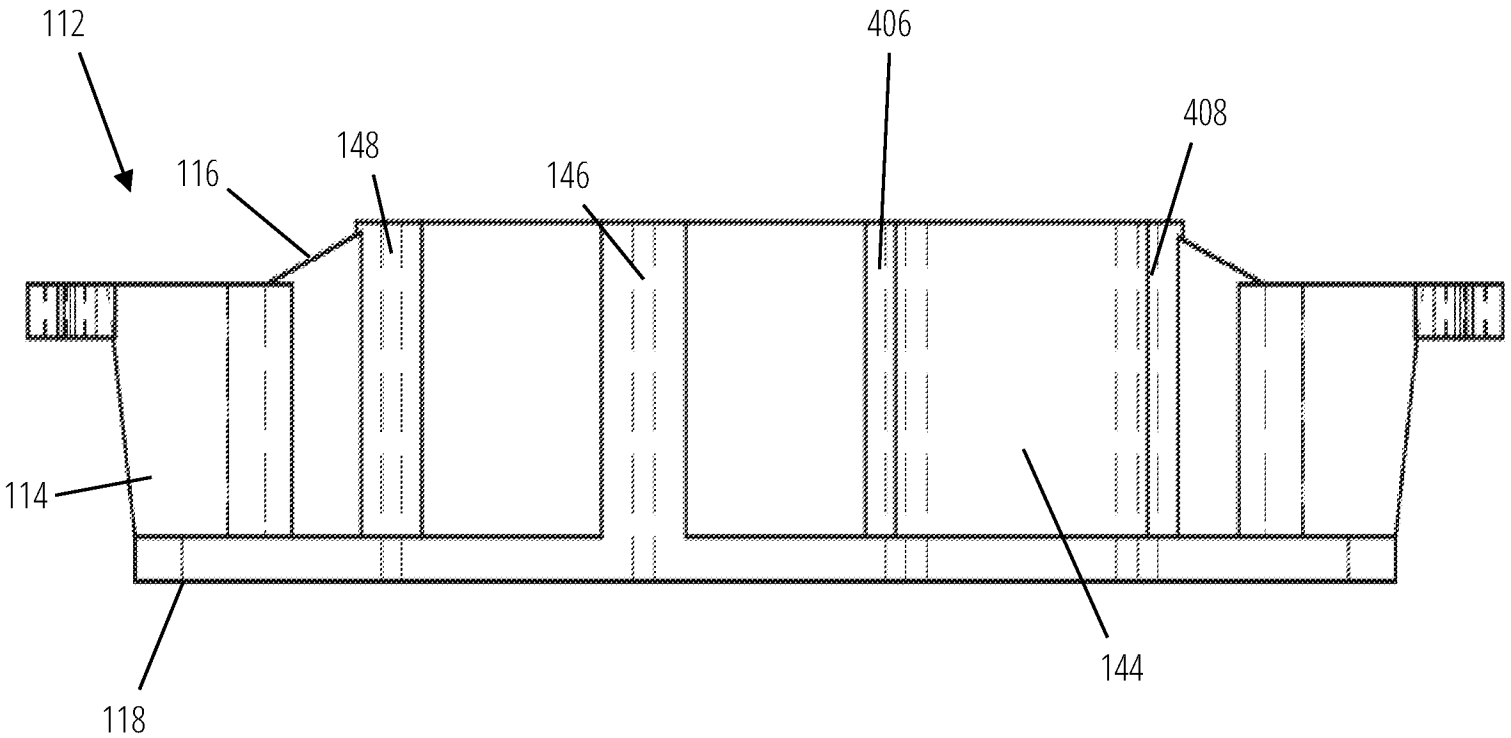
FIG. 5 is a side view of a bracket of a forming apparatus constructed according to the teachings of the present disclosure.

Referring to the particular form of FIGS. 4-5, a particular form of the bracket 112 is disclosed therein. The bracket 112 of this particular form comprises a first slot 144 and second slot 146. The first slot 144 has a first longitudinal axis 402 and the second slot 146 has a second longitudinal axis 404, which axes are perpendicular to one another. As such, in this particular form, the first slot 144 and the second slot 146 are substantially perpendicular to one another along the bracket body 114.

The one or more slots 120, and in this particular form, the first slot 144 and the second slot 146 extend through the bracket body 114 from the outer face 116 to the inner outer face 116. This permits a user to insert a cantilever member 122 into the one or more slots 120, and can insert the cantilever member 122 through the entire bracket body 114 to optionally extend a portion of the fastening end 134 out of the inner face 118 and a portion of the insertion end 132 outward from the outer face 116.

Furthermore, referring to FIG. 1, and FIGS. 4-5, the bracket 112 may optionally comprise one or more tie-wire apertures. The bracket 112 of this particular form comprises a first tie-wire aperture 148, a second tie-wire aperture 406 and a third tie-wire aperture 408. The first tie-wire aperture 148, the second tie-wire aperture 406 and the third tie-wire aperture 408 extend through the bracket body 114 from the outer face 116 to the inner face 118. As discussed below, each of the one or more tie-wire apertures are configured to received a tie-wire, which may optionally be used during forming operations to further support the foam coping core 104 against the wall.

Figure 6:
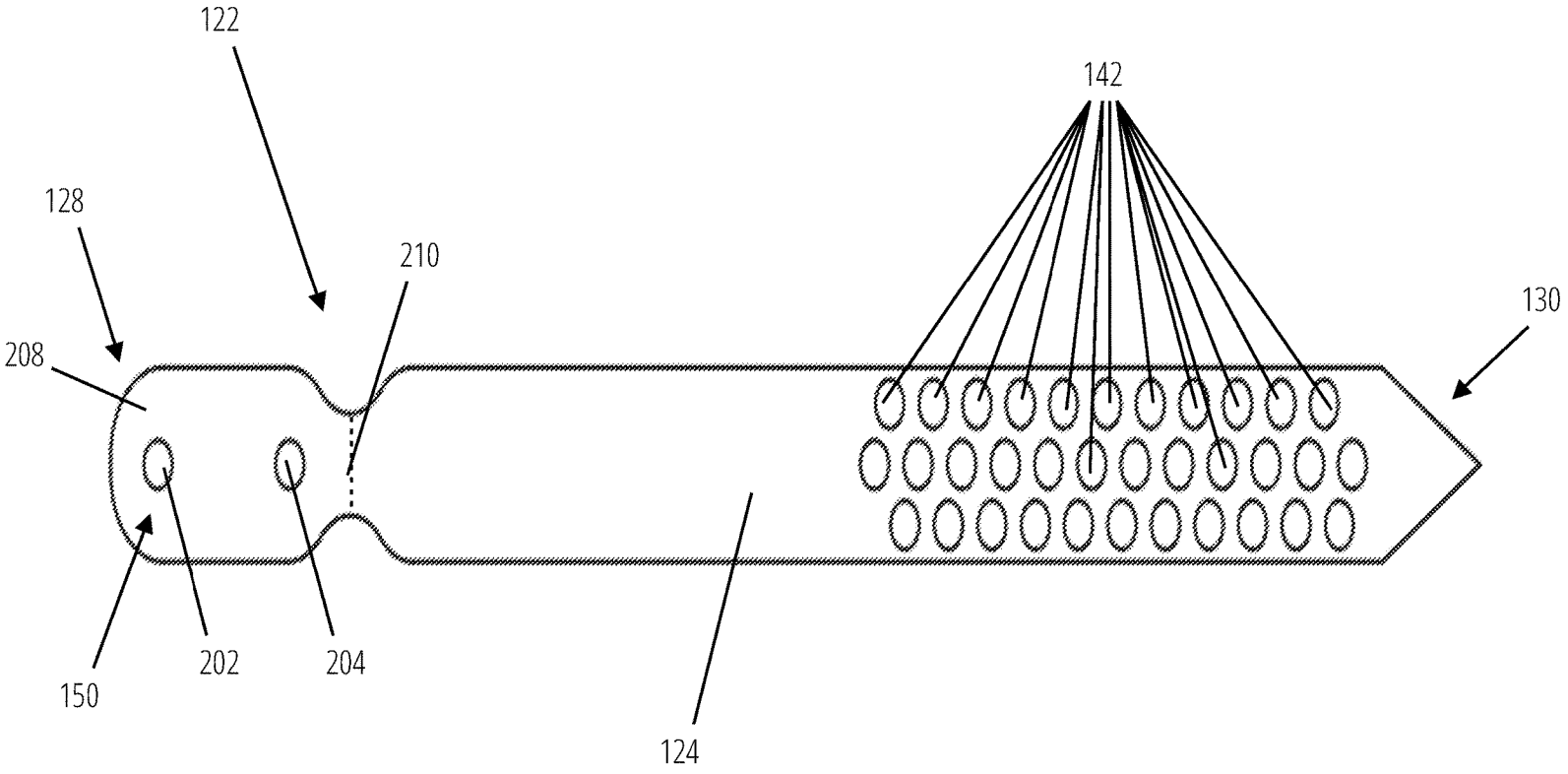
FIG. 6 is a top view of the top surface of a cantilever member of a forming apparatus constructed according to the teachings of the present disclosure.

Disclosed in FIG. 6 is the particular form of the cantilever member 122. As shown, the cantilever member 122 comprises a top surface 124. As discussed above, the locking mechanism 136 of this particular form comprises a plurality of pinhole apertures 142 spread substantially across the cantilever member 122. In use, any number of plurality of pinhole apertures 142 and configuration can be optionally implemented based on user needs.

Furthermore, the cantilever member 122 may further comprise one or more fastening apertures 150 disposed upon the fastening end 128 of the cantilever member 122, the one or more fastening apertures 150 extending through the cantilever member 122 from the top surface 124 to the bottom surface 126. In the particular form of FIG. 6, the one or more fastening apertures 150 comprises a first fastening aperture 202 and a second fastening aperture 204. However, one skilled in the art would appreciate that any number of fastening apertures may optionally be included and used without departing from the scope of teaching of the subject matter disclosed and claimed herein.

Referring to FIGS. 7-10, an example of the use of the forming apparatus 102 of the particular form is shown in greater detail. In the particular form disclosed herein, the forming apparatus 102 is used for a cement forming operation for forming a swimming pool coping. However, as will be readily apparent from the teaching disclosed herein, the forming apparatus 102 of the disclosed subject matter could be implemented in any number of cement forming operations and applications, and is not limited to the particular examples or forms disclosed herein.

Referring back to FIG. 7, a user can press the bracket 112 against the foam coping core 104, with the inner face 118 of the bracket 112 pressed against the outer surface 110 of the foam coping core 104. The inner surface 108 of the foam coping core 104 is pressed against the outside face 710 of the swimming pool coping 702. A particular profile portion 152 of the inner surface 108 extends upward above the top face 704 of the swimming pool coping 702.

With the bracket 112 pressed against the foam coping core 104, thereby securing the foam coping core 104 against the outside face 710 of the swimming pool coping 702, a user may then insert the insertion end 130 of the cantilever member 122 through the inner surface 108 of foam coping core 104, through the core body 106 and out from the outer surface 110. A portion of the insertion end received within the one or more slots 154 of the cantilever member 122 is received within the one or more slots 120. In this particular form, the cantilever member 122 is received within the second slot 146.

With the cantilever member 122 received within the second slot 146, a user would then secure the cantilever member 122 within the second slot 146 in order to secure the bracket 112 against the foam coping core 104 and the foam coping core 104 against the outside face 710 during the coping operation. A user may use any number of knowing securing mechanisms or techniques known in the art to secure the cantilever member 122 within the second slot 146. For example, although not illustrated, a user may drive a nail through the cantilever member 122 or use a C-clamp to hold the cantilever member 122 securely within the second slot 146 and the bracket 112 against the foam coping core 104. Also, any number of fasteners, such as screws or tie-wires, could be used to secure the cantilever member 122 within the second slot 146 and the bracket 112 firmly in place against the foam coping core 104 during the coping operation.

Figure 7:
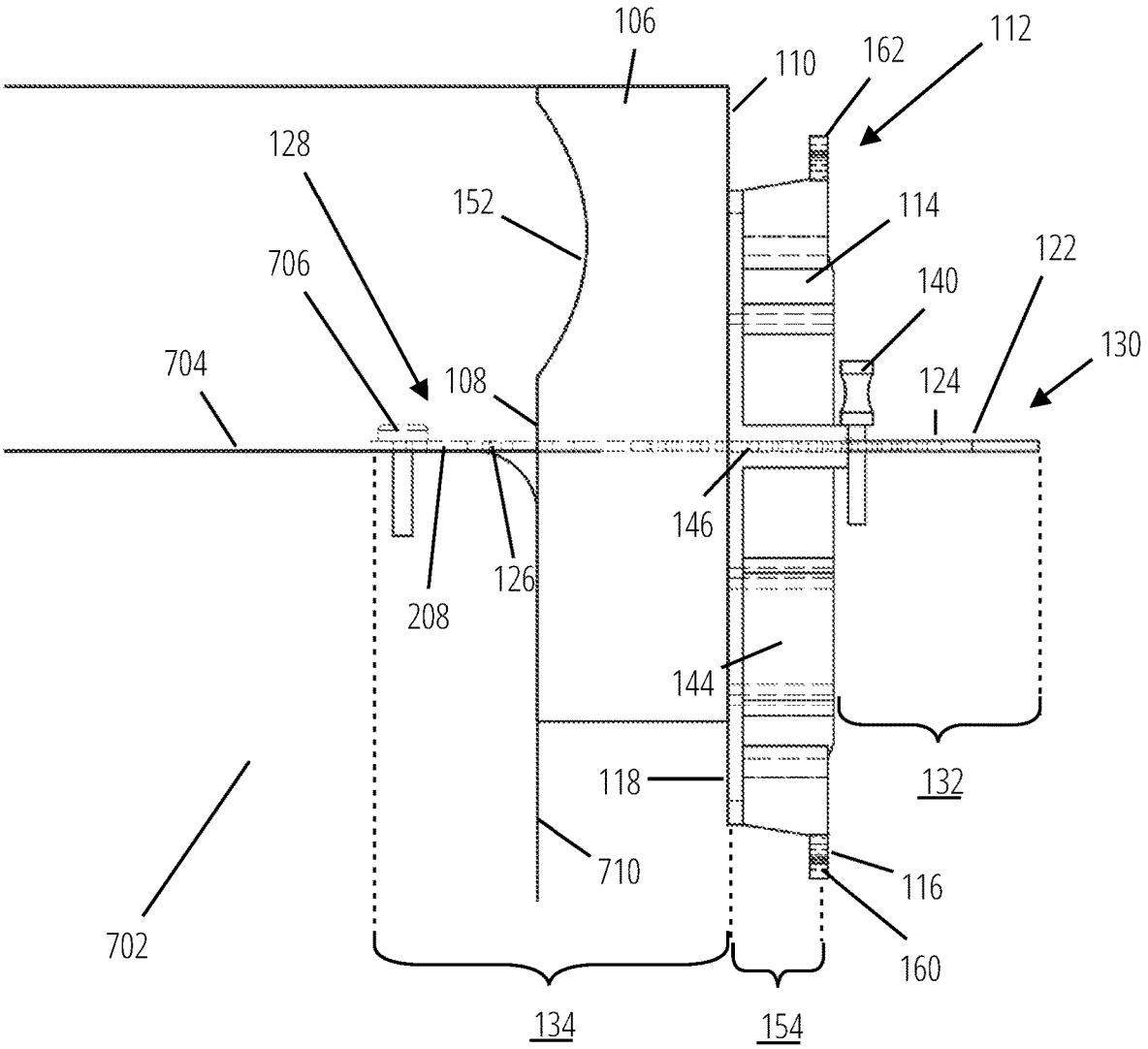
FIG. 7 is a side view of a forming apparatus in use according to the teachings of the present disclosure.
Figure 8:
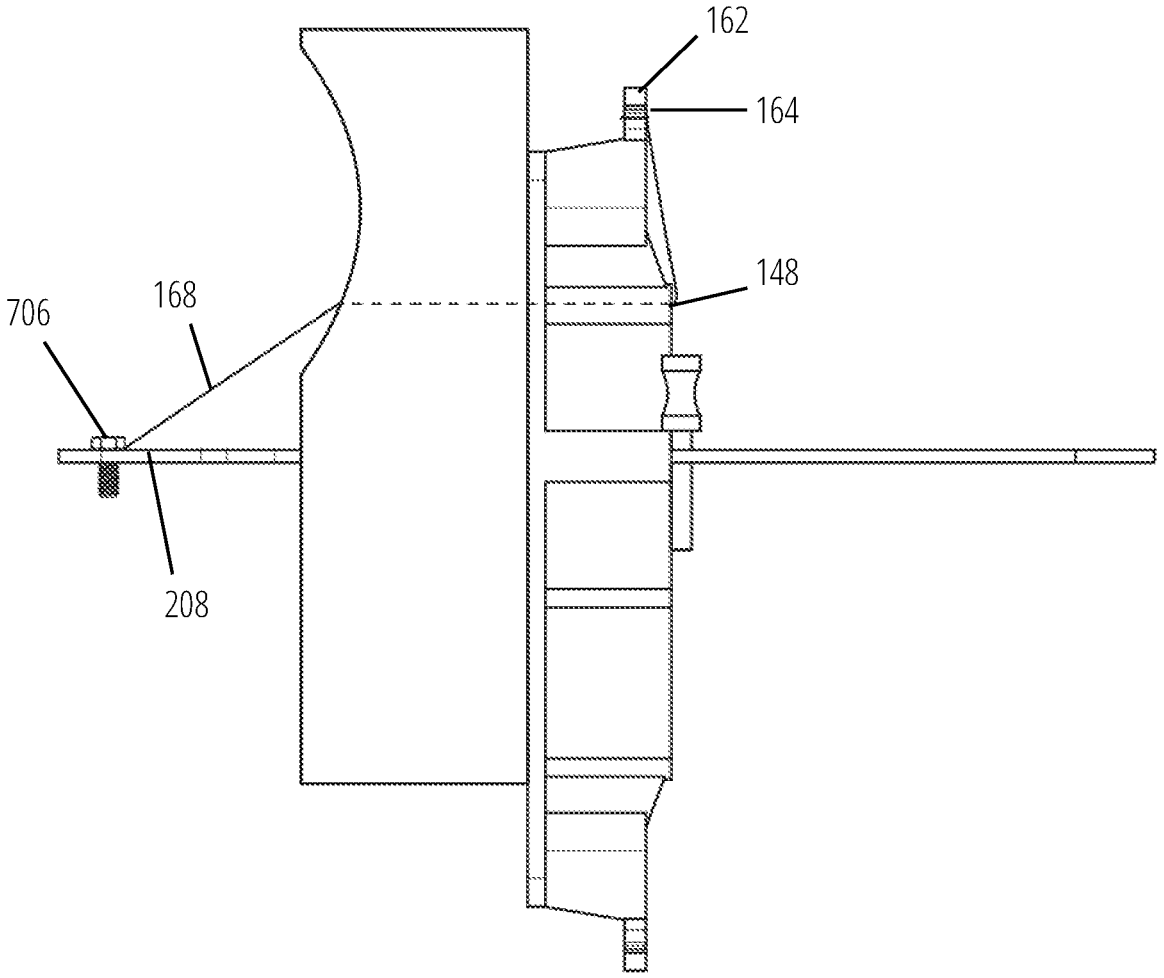
FIG. 8 is a side view of a forming apparatus in use according to the teachings of the present disclosure.

Alternatively, as disclosed in the form of FIGS. 7-8, the locking mechanism 136 may be used to secure the cantilever member 122 within the second slot 146. As shown, the pin 140 is used to secure the cantilever member 122 within the second slot 146, as it is inserted into one of the pin holes of the plurality of pinhole apertures 142 of the cantilever member 122. The fastening end 128 of the cantilever member 122 is pressed against the swimming pool coping 702, with the bottom surface 126 of the cantilever member 122 pressed against the top face 704 of the swimming pool coping 702. The fastening end 128 may then be fastened to the top face 704 of the swimming pool coping 702 using any suitable mechanism known in the art. A fastening screw 706 is inserted through one of the one or more fastening apertures 150 in order to secure the cantilever member 122 to the top face 704 of the 802. However, any number of fastening mechanisms known in the art may be implemented in order to secure the cantilever member 122 to the swimming pool coping 702.

Referring to the particular form of FIG. 8, a securing line 168 may optionally be utilized to further secure the bracket 112 against the foam coping core 104 during the coping operation. The securing line 168 may be tightly wound against the fastening screw 706, and pulled through the core body 106. The securing line 168 may then be pulled through the bracket body 114 via one of the one or more pin hole apertures 138. The securing line 168 is pulled through the first tie-wire aperture 148 and tightly wrapped around the top spool 162. The securing line 168 may then be secured within the top tapered slot 164, thereby reducing tightly securing the securing line 168 to the bracket 112. With the securing line 168 tightly secured, the securing line 168 assists in further securing the bracket 112 against the foam coping core 104, thereby further securing the foam coping core 104 against the outside face 710 during the coping operation.

With respect to the disclosed form of FIG. 7, with the cantilever member 122 secured to the swimming pool coping 702 and secured within the second slot 146 using the locking mechanism 136, and specifically in this form, the pin 140, the bracket 112 securely presses the foam coping core 104 to the swimming pool coping 702 to prevent the foam coping core 104 from undue shifting and movement during the cement forming operation. With the foam coping core 104 securely held in place by the forming apparatus 102, liquefied cement may then be poured along the top face 704 of the swimming pool coping 702, the liquefied cement pressing up against the profile portion 152 of the inner surface 108 of the foam coping core 104 and taking the shape of the profile portion 152.

Once the liquefied cement dries and solidifies, the foam coping core 104 may be removed. This is accomplished by unsecuring the locking mechanism 136 specific to the form disclosed in FIG. 7, the pin 140 is removed, thereby allowing a user to slide the bracket 112 outward from the insertion end 130 of the 122. The cantilever member 122 may be removed from the swimming pool coping 702. According to the particular disclosed form, a user may break the cantilever member 122 along the breaking segment 206 in order to release the cantilever member 122 from the swimming pool coping 702. For example, a user may break the cantilever member 122 along the narrowed portion 210, thereby leaving the breakable portion 208 left within the formed cement and removing the remainder of the cantilever member 122. The breakable portion 208 is a relatively small portion of the cantilever member 122 and as such, it remains largely unseen within the cement after pouring is completed and the cantilever member 122 is removed. A user can break the breakable portion 208 using any known techniques, including (but not limited to) simply gripping the cantilever member 122 and using a slide hammer to disconnect the breakable portion 208. Alternatively, user may simply pull the cantilever member 122 to remove it from the poured concrete. After removal, the cantilever member 122 may be discarded completely. Thus, a user may then reuse the bracket 112 again for subsequent forming operations, needing only to replace the cantilever member 122 with a new one.

The cantilever member 122 and the bracket 112 of this particular form, permit a user to optionally adjust the portion of the fastening end 134 extending outward from the inner face 118 as well as the portion of the insertion end 132 extending outward from the outer face 116. This permits a user to use the same bracket 112 and cantilever member 122 for any number of different forming applications, including accommodating for foam coping cores having varying configurations and thicknesses. Furthermore, a user may adjust the portion of the fastening end 134 extending out from the inner face 118 of the bracket 112 if greater cantilevering is required for a specific application.

Optionally, if greater securing force is required, a user may optionally implement one or more tie-wires to secure the bracket 112 and foam coping core 104 to the swimming pool coping 702. Although not specifically shown, the one or more tie-wires may be inserted into any one of the one or more tie-wire apertures disclosed herein.

Figure 9:
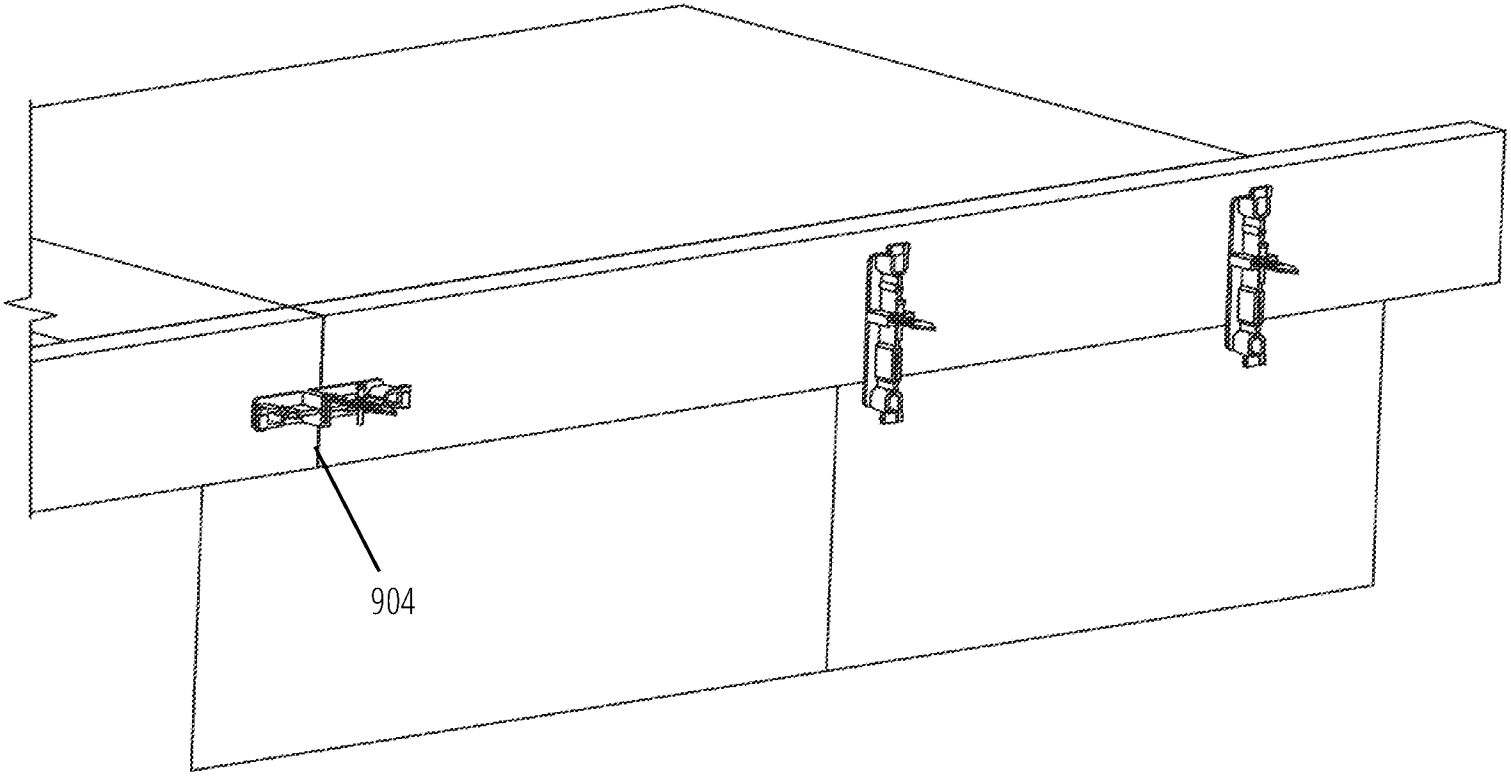
FIG. 9 is a perspective view of a forming apparatus according to the teachings of the present disclosure.
Figure 10:
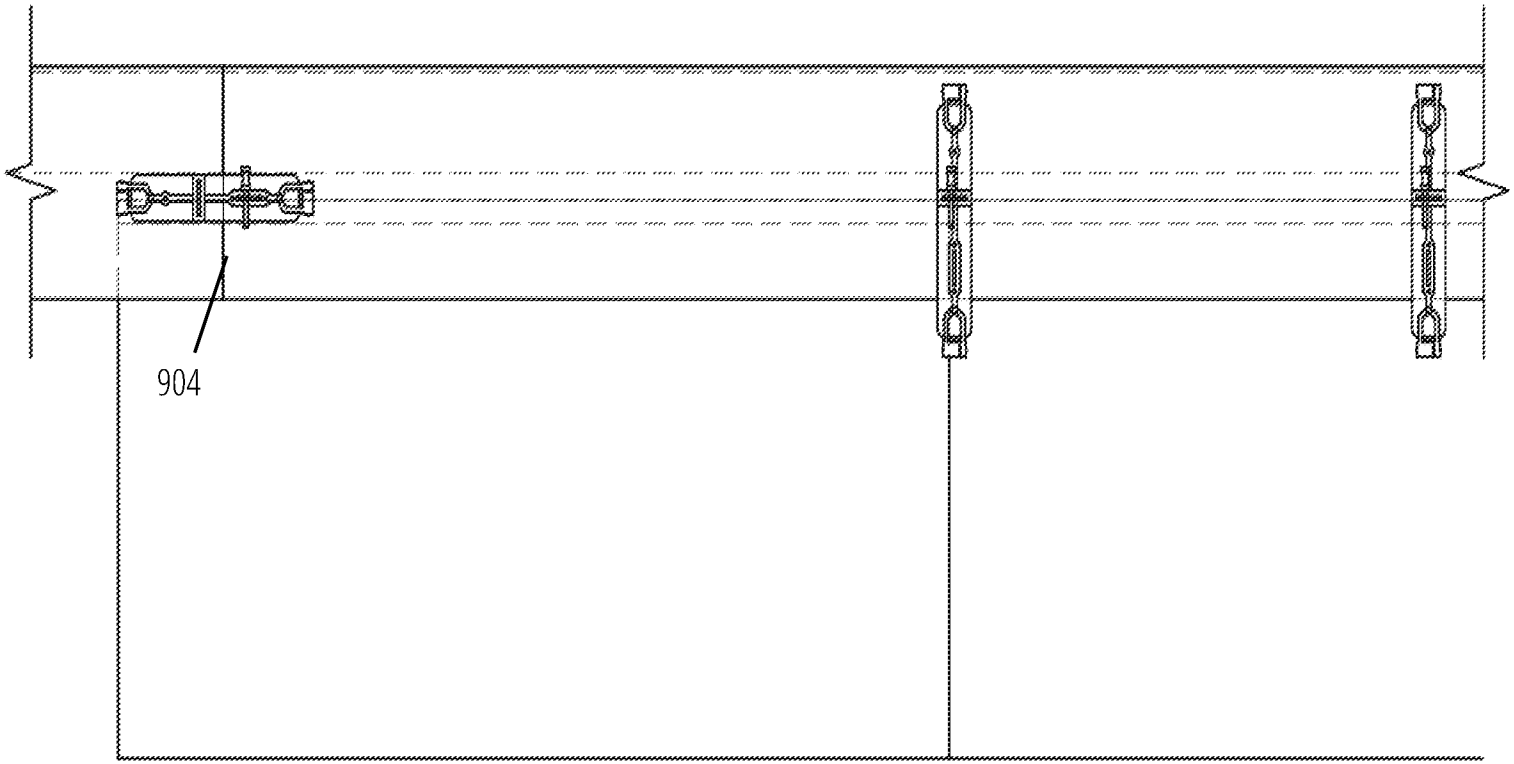
FIG. 10 is a side view of the forming apparatus in use according to the teachings of the present disclosure.

Furthermore, referring to FIGS. 9-10, the use of various configurations and positioning of the one or more slots 120 allows a user to adjust the positioning of the bracket 112 for various needs and requirements. The perpendicular positioning of the first slot 144 and the second slot 146 relative to one another and to the bracket body 114 would allow a user to turn the bracket 112 to cross a separation line 904 between two different foam coping cores, thereby not only securing the foam coping cores to the wall, but also securing the foam coping cores in place adjacent to one another. As such, according to the teachings disclosed herein, one skilled in the art will appreciate that the forming apparatus 102 could incorporate any number of slots, in substantially different orientations to one another. The arrangements disclosed herein permit a single bracket 112 to be used, and reused, for different forming operations involving different foam coping cores in different arrangement, allowing the user to adjust how the cantilever member 122 is secured within the one or more slots 120 (i.e. optionally adjusting the portion of the fastening end 134 extending outward from the inner face 118 and the portion of the insertion end 132 extending outward from the outer face 116), inserting the cantilever member 122 into any one of the one or more slots 120, incorporating any number of slots and providing for various orientations of the slots relative to one another.

The bracket 112 and the cantilever member 122 of the forming apparatus 102 disclosed herein may be formed from any materials and according to any process known in the art, including but not limited to injection molding. As disclosed in detail herein, the particular configurations are exemplary and non-limiting, and based on the teachings of the subject matter disclosed herein a user may modify the configurations of any one of the bracket 112, one or more slots 120, cantilever member 122, one or more pin hole apertures 138 and the pin 140 based on specific needs. Accordingly, the forming apparatus 102 as disclosed herein may be used to compensate for various foam core height profiles, with the same bracket 112 being used to compensate for foam coping core 104 profiles of differing heights by adjusting the orientation of the bracket 112. Brackets may be offset from one another to compensate for different shapes and sizes.

While the present disclosure has been described in connection with certain forms, it is to be understood that the present disclosure is not to be limited to the disclosed forms but, on the contrary, is intended to cover various modifications and equivalent arrangements included within the spirit and scope of the appended claims, which scope is to be accorded the broadest interpretation so as to encompass all such modifications and equivalent structures as is permitted under the law.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A forming apparatus for securing a coping core to a wall during cement forming operations, the coping core having a core body with an outer surface and an inner surface opposing the outer surface, the apparatus comprising:

a bracket having a bracket body having an outer face and an opposing inner face, the inner face configured to press against the outer surface of the coping core, and one or more slots extending through the bracket body from the outer face to the inner face, wherein the one or more slots comprises a first slot and a second slot having substantially different orientations relative to one another along the bracket body; and a cantilever member configured for insertion through the bracket body via the one or more slots, the cantilever member having a top surface and an opposing bottom surface, a fastening end and an opposing insertion end configured for insertion through the core body and the one or more slots thereby extending at least a portion of the fastening end outward from the inner face of the bracket and at least a portion of the insertion end received within the one or more slots.

2. The forming apparatus of claim 1, wherein the cantilever member comprises a plate.

3. The forming apparatus of claim 1, wherein at least the portion of the insertion end received within the one or more slots further extends outward from the outer face of the bracket.

4. The forming apparatus of claim 1, further comprising a locking mechanism for securing the cantilever member within the one or more slots.

5. The forming apparatus of claim 4, wherein the locking mechanism comprises one or more pinhole apertures extending through the cantilever member from the top surface to the bottom surface, and a pin configured for being releasably secured within the one or more pinhole apertures.

6. The forming apparatus of claim 5, wherein the one or more pin hole apertures comprises a plurality of pinhole apertures spread substantially across the cantilever member.

7. The forming apparatus of claim 1, wherein the first and second slot are substantially perpendicular relative to one another along the bracket body.

8. The forming apparatus of claim 1, further comprising one or more tie-wire apertures extending through the bracket body from the outer face to the inner face, the one or more tie-wire apertures configured to receive a tie-wire.

9. The forming apparatus of claim 1, further comprising one or more fastening apertures disposed upon the fastening end of the cantilever member, the one or more fastening apertures extending through the cantilever member from the top surface to the bottom surface.

10. The forming apparatus of claim 1, wherein the fastening end further comprises a breaking segment defining a breakable portion.

11. The forming apparatus of claim 10, wherein the breaking segment comprises a narrowed portion formed upon the fastening end of the cantilever member.

12. The forming apparatus of claim 1, wherein the bracket further comprises one or more spools.

13. The forming apparatus of claim 12, wherein the bracket further comprises a top end and a bottom end, and wherein the one or more spools comprises a top spool disposed upon the top end of the bracket and a bottom spool disposed upon the bottom end.

14. The forming apparatus of claim 12, further comprising one or more securing line holding members.

15. The forming apparatus of claim 14, wherein the one or more securing line holding members comprise a tapered slot.

16. The forming apparatus of claim 14, wherein the one or more securing line holding members are disposed upon the one or more spools.

17. The forming apparatus of claim 16, wherein the one or more spools comprise a top spool and a bottom spool, and the one or more securing line holding members comprise a top tapered slot disposed upon the top spool and a bottom tapered slot disposed upon the bottom spool.

* * * * *